US010539284B2

(12) United States Patent
Kauschke et al.

(10) Patent No.: US 10,539,284 B2
(45) Date of Patent: Jan. 21, 2020

(54) HEADLAMPS FOR VEHICLES

(71) Applicant: Hella GmbH & Co. KGaA, Lippstadt (DE)

(72) Inventors: Rainer Kauschke, Lippstadt (DE); Frank Passgang, Lippstadt (DE); Herbert Cramer, Rüthen (DE); Hendrik Weise, Lippstadt (DE)

(73) Assignee: Hella GmbH & Co. KGaA, Lippstadt (DE)

( * ) Notice: Subject to any disclaimer, the term of this patent is extended or adjusted under 35 U.S.C. 154(b) by 0 days.

(21) Appl. No.: 16/098,219

(22) PCT Filed: Apr. 28, 2017

(86) PCT No.: PCT/EP2017/060179
§ 371 (c)(1),
(2) Date: Nov. 1, 2018

(87) PCT Pub. No.: WO2017/191047
PCT Pub. Date: Nov. 9, 2017

(65) Prior Publication Data

US 2019/0162378 A1 May 30, 2019

(30) Foreign Application Priority Data

May 4, 2016 (DE) ..... 10 2016 108 265

(51) Int. Cl.
*F21S 41/16* (2018.01)
*F21S 41/255* (2018.01)
(Continued)

(52) U.S. Cl.
CPC ..... *F21S 41/16* (2018.01); *F21S 41/255* (2018.01); *F21S 41/36* (2018.01); *F21S 41/365* (2018.01); *F21S 41/43* (2018.01)

(58) Field of Classification Search
CPC ..... F21S 41/16; F21S 41/36; F21S 41/365
See application file for complete search history.

(56) References Cited

U.S. PATENT DOCUMENTS 3,808,422 A * 4/1974 Handtmann ..... G02B 27/283 362/19
4,219,867 A * 8/1980 Zehender ..... G02B 27/283 362/518
(Continued)

FOREIGN PATENT DOCUMENTS

DE 102012220472 A1 5/2014
DE 102012223610 A1 6/2014
(Continued)

*Primary Examiner* — Alexander K Garlen
*Assistant Examiner* — Eric T Eide
(74) *Attorney, Agent, or Firm* — Husch Blackwell LLP

(57) ABSTRACT

A headlamp for vehicles with a laser module comprising a laser light source for the radiation of a laser light beam, and an optic unit to shape the laser light beam to form a given light distribution. The optic unit has a primary optic device for the imaging of an intermediate image on an intermediate image plane. The optic unit has a deflection device which is arranged in an intermediate image plane and which has a limiting edge by means of which a share of the light of the laser light beam is deflected along a light path in the direction of a bundling device, by means of which the share of light is deflected into a light distribution while forming a cut-off line.

10 Claims, 3 Drawing Sheets

(51) Int. Cl.

| | |
|---|---|
| ***F21S 41/36*** | (2018.01) |
| ***F21S 41/43*** | (2018.01) |
| ***F21S 41/365*** | (2018.01) |

(56) References Cited

U.S. PATENT DOCUMENTS

| | | | | |
|---|---|---|---|---|
| 7,070,308 | B2 * | 7/2006 | Shikano | F21S 41/135 362/510 |
| 2008/0225540 | A1 * | 9/2008 | Tsukamoto | F21V 13/04 362/514 |
| 2014/0177252 | A1 * | 6/2014 | Lai | B60Q 1/085 362/514 |
| 2015/0362154 | A1 * | 12/2015 | Liao | F21V 9/40 362/84 |
| 2016/0290583 | A1 * | 10/2016 | Suwa | F21S 41/143 |

FOREIGN PATENT DOCUMENTS

| | | | |
|---|---|---|---|
| DE | 112014005269 | | 8/2016 |
| EP | 1970617 | A1 | 9/2008 |
| JP | 2014003037 | A | 1/2014 |
| WO | 2015055109 | A1 | 4/2015 |

* cited by examiner

HEADLAMPS FOR VEHICLES

CROSS REFERENCE

This application claims priority to PCT Application No. PCT/EP2017/060179, filed Apr. 28, 2017, which itself claims priority to German Patent Application 10 2016 108265.1, filed May 4, 2016, the entirety of both of which are hereby incorporated by reference.

FIELD OF THE INVENTION

The invention relates to headlamps for vehicles with a laser module comprising a laser light source for the radiation of a laser light beam and an optic unit to shape the laser light beam to form a given light distribution.

BACKGROUND

From DE 10 2012 220 472 A1, a headlamp for vehicles is known, which has a laser module with a laser light source for the generation of a laser light beam. To generate a given light distribution, an optic unit with a deflecting reflector is provided, by means of which a given light distribution is generated. As a cut-off line cannot be generated by means of the deflecting reflector, the laser module can only be used for the generation of a high beam light function. It is, however, desirable that the laser modules can also be used for the generation of at least one light distribution having a cut-off line, as for example low beam light distributions or a dazzle-free high beam.

SUMMARY OF THE INVENTION

It is therefore the task of the present invention to develop a headlamp for vehicles with a laser module further so that light distributions with a cut-off line, i.e. with a sufficiently large illuminance gradient and or a fore field gradient, can be generated.

The particular advantage of the invention lies in the fact that a light distribution with a cut-off line can be generated easily.

In a preferred embodiment of the invention, the advantage is that by providing in particular a first deflection device with a limiting edge, a light distribution with a cut-off line can be generated. The cut-off line of the light distribution shows illuminance gradients fulfilling legal lighting requirements. By means of a second deflection device, a further, second share of light of the laser light beam, which comprises in particular a residual share of light, can be deflected so that a second partial light distribution generated by the latter overlaps a first partial light distribution generated by the first share of light, so that the desired cut-off line is generated and at the same time an illuminance, which is as high as possible, can be realized. By means of the second deflection device and/or by means of a second bundling device, the second share of light is influenced so that an optimal matching with regard to the first share of light is achieved. Therefore, an efficient use of the luminous flux of the laser light source can be provided.

According to a preferred embodiment of the invention, the first deflection device is offset relative to the second deflection device in the main radiation direction of the laser light source, respectively the headlamp. By differing guidance of the light by these two units, the first share of light and the second share of light are deflected in different directions and are further deflected by lateral bundling devices arranged accordingly to overlap the same in the light distribution. The first deflection device serves the generation of the actual cut-off line, as it is situated in an intermediate image plane onto which the intermediate image of the laser light source is projected by means of a primary optic unit. By means of the second deflection device, which is arranged in an offset manner in the axial direction, i.e. in the direction of the optical axis relative to the first deflection device, a deflection, i.e. an adaptation of the remaining second share of light can be achieved with the aim that on one hand, as little as possible of the second share of light is lost and on the other hand the requirements with regard to contrast at the cut-off line are fulfilled.

According to a further development of the invention, the second deflection device and/or the second bundling device is/are embodied in a manner, that the second share of light is reflected in the intermediate image plane relative to the limiting edge of the first share of light, so that an increase of the illuminance values of the first and the second light distribution run in the same direction. Advantageously, an optimal light distribution with a cut-off line can be generated by this means.

According to a further development of the invention, the limiting edge of the first deflection device in the intermediate image plane runs vertically and/or horizontally, so that a vertical and/or horizontal cut-off line can be generated. Vertical and horizontal cut-off lines can also be combined, so that the resulting light distribution extends for example in a peripheral angle of 270°, wherein a quadrant is spared. The most various customer-specific requirements can be fulfilled in an advantageous manner by this means.

According to a further development of the invention, a left hand headlamp in the driving direction with a first deflection device is provided, having a first limiting edge (for example a limiting edge arranged on the left in the driving direction) for the forming of a left-hand vertical cut-off line in the light distribution for the generation of a light distribution with vertical cut-off lines on the left hand side and on the right hand side. In addition, a right hand headlamp in the driving direction with a second limiting edge (for example a limiting edge arranged on the right in the driving direction) is provided for the forming of a right-hand vertical cut-off line in the light distribution.

According to a further development of the invention, the first and/or the second deflection device arranged in a pivoted or tiltable manner around a vertical axis and/or around a horizontal axis. By this means, an adaptive high beam distribution, which does not dazzle the oncoming traffic and/or by horizontal tilting, a low beam or a motor way light distribution and/or headlamp levelling can be generated.

Further advantages of the invention result from the further sub-claims.

Reference is now made more particularly to the drawings, which illustrate the best presently known mode of carrying out the invention and wherein similar reference characters indicate the same parts throughout the views.

Figure 7A:
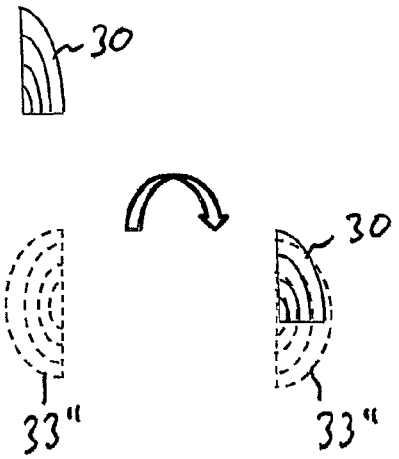
FIG. 7*a* is a representation of a quadrant-shaped light distribution instead of a semicircular one, wherein the second deflection device is embodied in a trough-shaped manner.
Figure 7B:
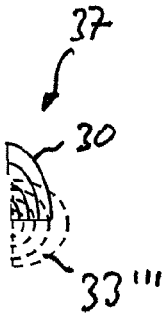

FIG. 7*b* is a representation of a compressed semicircular second share of light, wherein the second light deflection device has a differing curvature.

Figure 7C:
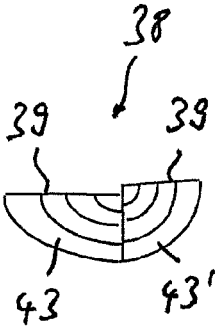

FIG. 7*c* is a representation of the combination of a first share of light and a second share of light, each having horizontal cut-off lines for the generation of a low beam light distribution.

DETAILED DESCRIPTION OF THE DRAWINGS

A headlamp for vehicles according to the invention serves the generation of a given light distribution, such as a low beam light distribution and such like, having at least a partial cut-off line. The headlamp has one or several laser modules 1, each of which having a laser light source 2 for the radiation of a laser light beam 3 on one hand and an optic unit 4 for the forming of the laser light beam 3 according to the given light distribution on the other hand.

The laser light source 2 has for example a laser material for the radiation of a laser light in a first spectral range, for example for the radiation of blue laser light. Furthermore, the laser light source 2 has a conversion element arranged in front of the laser material, which converts part of the laser light radiated by the laser material into light of a second spectral range (yellow light) and is then radiated as a white laser light beam 3 by means of an additive mixture with the non-converted blue light. The conversion element has a luminescent substance, for example phosphor, which is irradiated in a transmissive of reflective manner.

The white laser light beam 3 hits a primary optic unit 5 of the optic unit 4, which is arranged in front of the laser light source 2 of the laser module 1 in the main radiation direction. The primary optic unit 5 can be embodied as a single- or multi-part imaging lens or as a freeform ellipsoid or as a freeform paraboloid, by means of which the laser light beam 3 is deflected onto an intermediate image plane 6 for the generation of an intermediate image 7 formed by a full circle light beam. In the intermediate image plane 6, a first deflecting unit 8 is arranged, which can for example be embodied as a 45° deflection mirror or as a shutter deflection mirror. The particularity of the first deflection device 8 consists in its having a limiting edge 9 resulting in a cut-off line after further forming of the light.

The first deflection device 8 is arranged in the intermediate image plane 6 so that the limiting edge 9 runs through an area of maximal light intensity of the intermediate image 7 respectively the laser spot. According to a first embodiment of the invention following the FIGS. 1 to 4, the limiting edge 9 runs through the center of the circular intermediate image 7 in the vertical direction, so that by means of the first deflection device 8, a first light share 10 of the laser light beam 3 is essentially deflected downward along a first light path 11 in the direction of a first bundling device 12, on which a further light deflection, namely essentially in the main radiation direction H, is executed to generate a first partial light distribution 13 (represented as a continuous line in FIG. 1) having a vertical cut-off line 14. The first bundling device 12 can for example be embodied as a reflector with preferably at least one reflector part or as a mirror.

The limiting edge 9 therefore runs in a straight line and preferably in the vertical direction to generate the vertical cut-off line 14. Alternatively, the limiting edge 9 can also be embodied in a non-straight, for example a curved manner to generate a curved vertical cut-off line. By means of a limiting edge with runs in a transverse or an inclined manner or at an acute angle relative to a vertical axis, an asymmetric low beam light distribution can for example be generated, wherein the transverse limiting edge is responsible for the 15 degree rise. The shape of the limiting edge determines the shape of the cut-off line.

Figure 1:
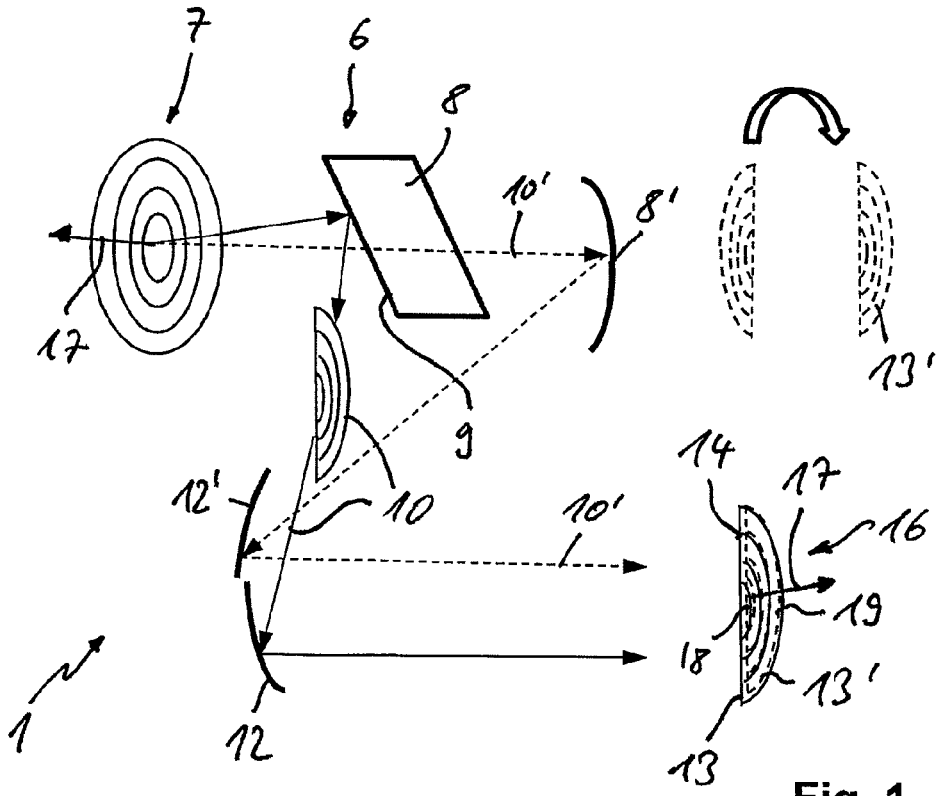
FIG. 1 is a schematic representation of a headlamp with a laser module for the generation of a light distribution with a vertical cut-off line.
Figure 2:
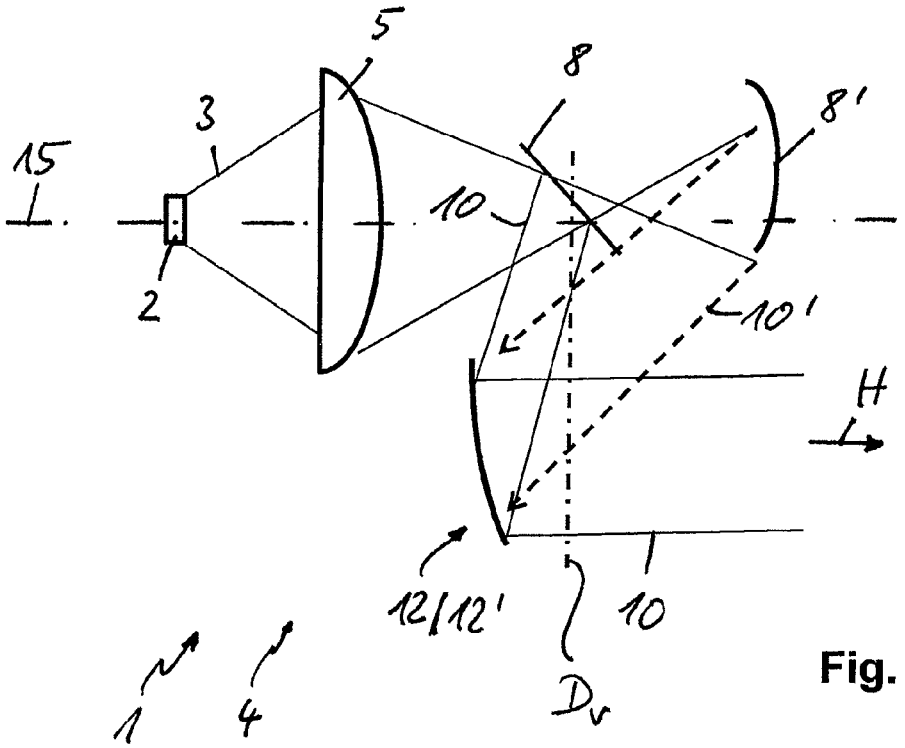
FIG. 2 is a schematic lateral view of the laser module according to FIG. 1.
Figure 3:
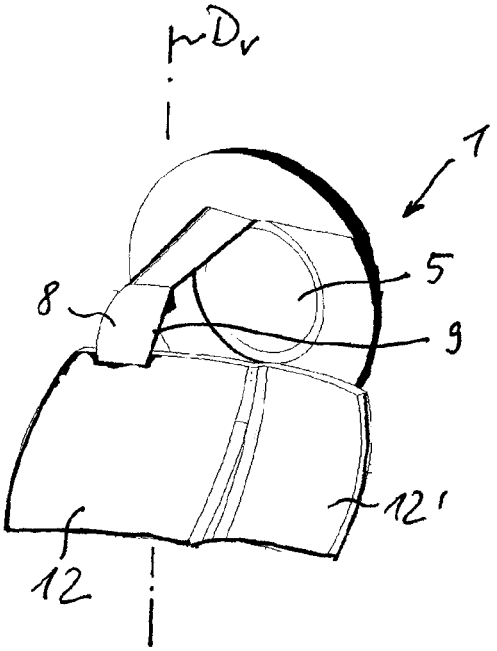
FIG. 3 is a perspective rear view of a first deflection device.

Arranged along an optical axis 15 and offset relative to the first deflection device 8, is a second deflection device 8' by means of which a second share of light 10' of the laser light beam 3, which is not captured by the first deflection device 8, is deflected along a second light path 11' in the direction of a second bundling device 12'. The second bundling device 12' is for example embodied as a reflector with preferably at least a reflector part or as a mirror. The second deflection device 8' is embodied so that the second share of light 10', being mirrored around a concave mirror focus point, hits the second bundling device 12'. By means of the second bundling device 12', the second share of light 10' is deflected in a manner, that a second partial light distribution 13' (represented in FIG. 1 by means of a dotted line) is generated which overlaps with the first partial light distribution 13 to form the given light distribution. As can be seen in FIG. 1, the second partial light distribution 13' is arranged on the same side of the vertical cut-off line 14 as the first partial light distribution 13, so that the second share of light 10' as a residual share causes the increased illuminance in the first partial light distribution 13. Due to the mirroring of the second share of light 10' relative to the vertical line, an increase in the light intensities in the first and second partial light distributions 13, 13' in the same direction 17 is the result. A first part 18 of the first partial light distribution 13 and/or the second partial light distribution 13', which is arranged in a region close to the vertical cut-off line 14, has a higher light intensity, and/or brightness than a second part 19 of the first partial light distribution 13 and/or the second partial light distribution 13', which is arranged further away from the vertical cut-off line 14.

Figure 4:
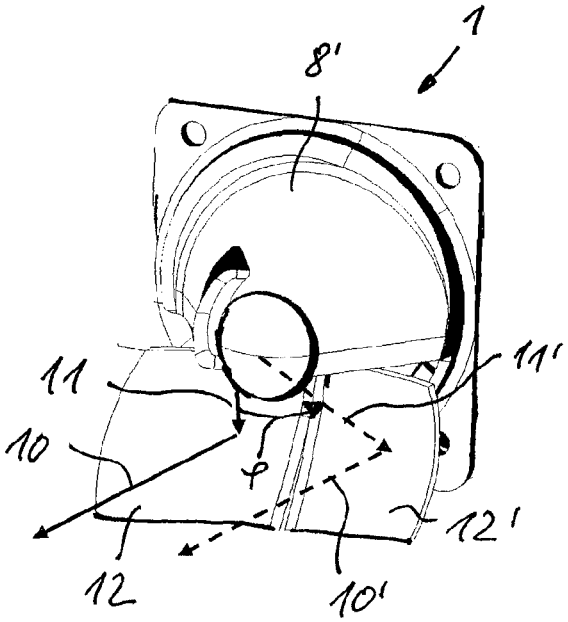
FIG. 4 is a perspective rear view of a second deflection device.

As can be seen in FIG. 4, the first deflection device 8 and/or the second deflection device 8' is embodied so that the second share of light 10' is deflected at an acute angle φ relative to the first share of light 10 with regard to a projection plane running vertical relative to the main radiation direction H. The first bundling device 12 and the second bundling device 12' are arranged next to one another in a horizontal direction.

Figure 5:
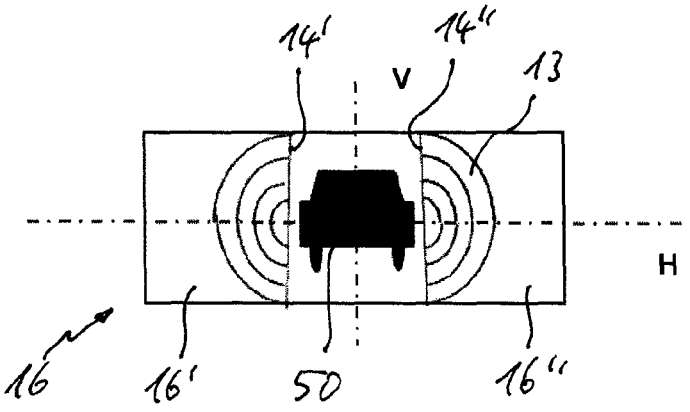
FIG. 5 is a schematic representation of a light distribution with vertical cut-off lines.

To generated a dazzle-free high beam light distribution 16, represented in FIG. 5, a left-hand headlamp and a right-hand headlamp with regard to the driving direction of the vehicle have laser modules 1 which are oriented in different directions. A left-hand headlamp with regard to the driving direction of the vehicle has such a first deflection device 8 with a limiting edge, arranged preferably on the left with regard to the driving direction of the vehicle, for the shaping of a left-hand vertical cut-off line 14' of a left-hand part 16' of the light distribution 16. A right-hand headlamp with regard to the driving direction of the vehicle has a first deflection device 8 with a limiting edge, arranged preferably on the right with regard to the driving direction of the vehicle, for the shaping of a right-hand vertical cut-off line 14" of a right-hand part 16" of the light distribution 16.

Herein, it is assumed that the laser module for the generation of the first part 16" of the high beam light distribution, represented in the FIGS. 1 to 4, is installed in the right-hand headlamp. Between the left-hand part 16' and the right-hand part 16" of the high beam light distribution 16, a cut-out area of the same is provided, in which an oncoming vehicle 50 or a vehicle 50 driving ahead exists. This prevents the dazzling of the vehicle 50. A control unit, which is not represented, acts upon the laser modules so that, depending on the current and/or relative position of the oncoming vehicle 50 or the vehicle 50 driving ahead relative to the vehicle having the laser modules, the cut-out area follows the oncoming vehicle 50 or the vehicle 50 driving ahead so that a dazzling of the same is avoided.

For the generation of different vertical cut-off lines 14, 14', for example for the adaptive high beam light distribution 16 cutting out the oncoming traffic, the bundling device 12, 12' is pivoted around a vertical axis of rotation Dv, wherein the axis of rotation Dv runs through the first deflection device 8. If required, the comple laser module 1 or only the deflection devices 8, 8' can be pivoted around the vertical axis of rotation Dv.

Alternatively, the bundling devices 12 and 12' can also be rotated independent of one another around the axis of rotation Dv to vary the overlapping of the partial light distributions 13, 13'. This is, alternatively or additionally, also provided for the deflection devices 8, 8'.

Figure 6:
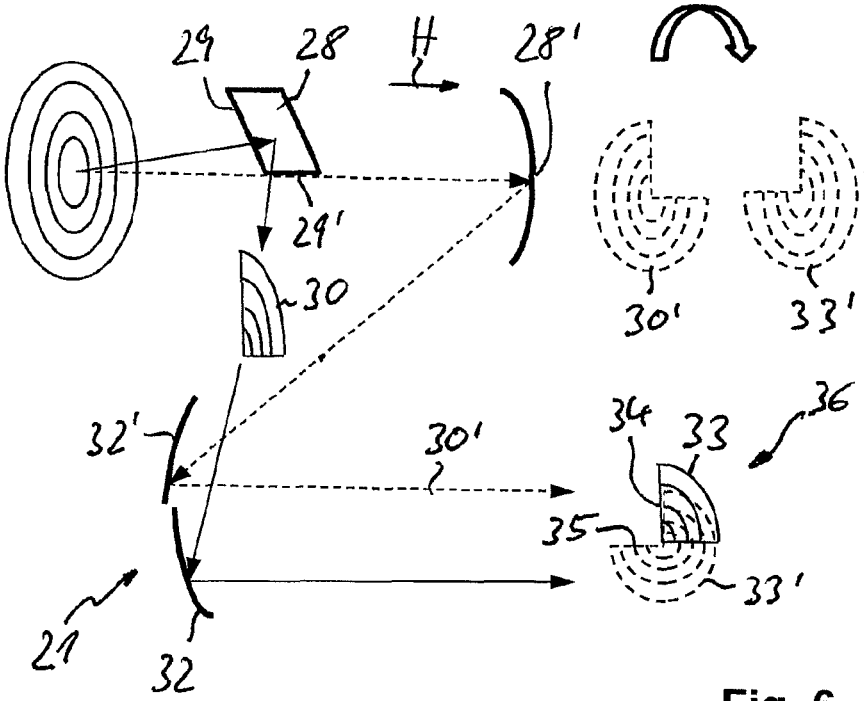
FIG. 6 is a schematic representation of a laser module for the generation of a 270° light distribution with a horizontal and vertical cut-off line

According to a second embodiment of the invention according to FIG. 6, a laser module 21 can be provided for the generation of a light distribution 36 having a vertical cut-off line 34 and a horizontal cut-off line 35. In FIG. 6, the design of the laser module 21 is represented in a schematic manner. This shows a first deflection device 28, by means of which a first share of light 30 being embodied in a quadrant-shaped form is deflected in the direction of a first bundling device 32. This first bundling device 28 has a vertical limiting edge 29 and a horizontal limiting edge 29' forming the vertical cut-off line 34 and/or the horizontal cut-off line 35 of a later first partial light distribution 33 projected by the first bundling device 32 (solid line in FIG. 6).

A second deflection device 28', by means of which a residual second share of light 30' of the laser light beam 3 is deflected in the direction of a second bundling device 32', is arranged in front of the first deflection device 28 in the main radiation direction H. The second deflection device 28' is embodied in a manner, that a point reflection is achieved, so that after the deflection of the second share of light 30', a second partial light distribution 33', generated in the second bundling device 32', overlaps the first partial light distribution 33 to form the light distribution 34. The overlapping is executed in a manner, that the light distribution 34 formed here has a desired light intensity distribution.

Different light distributions with given high illuminance gradient and/or different fore field gradients (by rounding of the edges of the limiting edge 29') can be generated in an advantageous manner.

As can be seen in FIG. 7*a*, the second deflection device 28' and/or the second bundling device 32' can also embodied so that a 180°-partial light distribution 33" is generated instead of a 270°-partial light distribution 33'.

Identical components and component functions of the embodiment examples are marked with identical reference signs.

According to a further alternative embodiment of the invention following FIG. 7*b*, the second deflection device 28' and/or the second bundling device 32' can also be embodied so that a compressed second partial light distribution 33'" is generated. By this means, a fore field light distribution 37 with a soft touch-down point can be generated. Depending on the embodiment of the second deflection device 28', and/or the second bundling device 32', a further adaptation with regard to height, width, and distribution of intensity of light distribution components 37 can be executed.

According to a further embodiment of the invention according to FIG. 7*c*, a low beam light distribution 38 with a horizontal cut-off line 39 can be generated, wherein the light distribution 38 is generated by the superposition of a first partial light distribution 43 and a second partial light distribution 43'. The first partial light distribution 43 and the second partial light distribution 43' are generated by means of appropriate modifications to the first deflection device 8, 28 and/or the second deflection device 8', 28', and/or the first bundling device 12, 32 and/or the second bundling device 12', 32'. By pivoting the laser module 1 responsible for the light distribution 38 around a horizontal axis of rotation, different light distributions, such as motorway light, low beam with adaptive cut-off line, can be generated or at least a vertical cut-off line, if only the share of light responsible for the light distribution 43' is moved upward. By this means, multifunctional laser systems can be realized in a luminous-flux-efficient manner.

LIST OF REFERENCE SIGNS

1 Laser module
2 Laser light source/converter
3 Laser light beam
4 Optic unit
5 Primary optic device
6 Intermediate image plane
7 Laser light beam (original beam)
8,8' 1st and 2nd deflection device
9 Limiting edge
10,10' 1st and 2nd share of light
11,11' 1st and 2nd light path
12,12' 1st and 2nd bundling device
13,13' 1st and 2nd partial light distribution
14,14',14" Vertical cut-off line
15 Optical axis
16 Light distribution
17 Direction
18 1. part
19 2. part
21 Laser module
28,28' 1st and 2nd deflection device
29,29' Limiting edge (vertical/horizontal (partially rounded))
30,30' 1st and 2nd share of light
32,32' 1st and 2nd bundling device
33,33' 1st and 2nd partial light distribution
34 Vertical cut-off line
35 Horizontal cut-off line
36 Light distribution
37 Light distribution
38 Light distribution
39 Horizontal cut-off line
43,43' 1st and 2nd partial light distribution
50 Vehicle

The invention claimed is:

1. A headlamp for vehicles with a laser module, the laser module comprising:

a laser light source for the radiation of a laser light beam; and an optic unit to shape the laser light beam to form a given light distribution, wherein the optic unit has a primary optic device for the imaging of an inter-mediate image on an intermediate image plane, and wherein the optic unit has a first deflection device with a limiting edge arranged in the intermediate image plane, by means of which a first share of light of the laser light beam is deflected along a first light path in a direction of a first bundling device, by means of which the first share of light is deflected to form a first partial light distribution while forming a cut-off line, and the optic unit has a second deflection device, by means of which a second share of light of the laser light beam not deflected by the first deflection device is deflected along a second light path in a direction of a second bundling device by means of which the second share of light is deflected to a second partial light distribution so that the second partial light distribution overlaps the first partial light distribution so that they form a light distribution, and wherein the second share of light is deflected at an acute angle (φ) relative to the first share of light with regard to a projection plane running vertically relative to a main radiation direction (H).

2. The headlamp laser module according to claim 1, wherein the first deflection device and the second deflection device are arranged in an offset manner in the main radiation direction (H).

3. The headlamp laser module according to claim 1, wherein the second deflection device and/or the second bundling device is/are embodied in a manner that the second share of the light is reflected at least once with regard to the limiting edge of the first share of the light, so that an increase in light intensities in the first partial light distribution runs in the same direction as that of the second partial light distribution.

4. The headlamp laser module according to claim 1 wherein the limiting edge runs at least one of vertically and horizontally to form a respective vertical and/or horizontal cut-off line of the light distribution.

5. The headlamp laser module according to claim 1 wherein a left-hand headlamp in the direction of travel of the vehicle has a first deflection device with a first limiting edge to form a left vertical cut-off line of the light distribution and a headlamp on the right in the direction of travel of the vehicle has a first deflection device with a second limiting edge to form a right vertical cut-off line of the light distribution.

6. The headlamp laser module according to claim 1 wherein the first deflection device and the second deflection device are pivoted around at least one of a vertical axis (DV) and a horizontal axis.

7. The headlamp laser module according to claim 1 wherein the primary optic device has at least one of a lens, a freeform ellipsoid, and a freeform paraboloid.

8. The headlamp laser module according to claim 1 wherein the first deflection device is embodied as a shutter-deflection-mirror and the second deflection device as a concave mirror.

9. The headlamp laser module according to claim 1 wherein at least one of the first bundling device and the second bundling device is/are embodied as at least one of a partial reflector and a mirror.

10. The headlamp laser module according to claim 1 wherein the laser light source has a laser light radiating laser material as well as a conversion element, wherein the laser light radiated from the laser material in a first spectral range is at least partially converted into laser light of a second spectral range by means of the conversion element, so that by superimposing the first and the second spectral range, the laser light beam is generated as white light.

* * * * *